United States Patent [19]

Collins

[11] Patent Number: 4,970,785

[45] Date of Patent: Nov. 20, 1990

[54] NON-METALLIC KNIFE

[75] Inventor: Walter W. Collins, North, S.C.

[73] Assignee: Wenoka Sea Style a Division of Schur, Inc., West Palm Beach, Fla.

[21] Appl. No.: 445,086

[22] Filed: Dec. 1, 1989

Related U.S. Application Data

[63] Continuation of Ser. No. 170,807, Mar. 21, 1988, abandoned.

[51] Int. Cl.[5] ..... B26B 1/00

[52] U.S. Cl. ..... 30/123; 7/118; 7/158; 30/329

[58] Field of Search ..... 30/123, 151, 152, 156–158, 30/304, 329, 338, 339, 349, 353, 357; 7/118–120, 158; 51/181 R, 205 R

[56] References Cited

U.S. PATENT DOCUMENTS

| | | | |
|---|---|---|---|
| 1,828,121 | 10/1931 | Adam et al. | 30/155 X |
| 2,114,569 | 4/1938 | Paolini et al. | 30/304 X |
| 2,448,957 | 9/1948 | Ciarlone | 30/339 X |
| 2,611,181 | 9/1952 | Coulter | 30/353 X |
| 3,686,799 | 8/1972 | Doty | 51/181 R |

*Primary Examiner*—Douglas D. Watts

*Attorney, Agent, or Firm*—Wolf, Greenfield & Sacks

[57] ABSTRACT

A knife constructed substantially of plastic and having interchangeable blades removably installed thereon and further having a butt cap disposed on the handle having annular grooves therein for interlockingly engaging O-rings for use in other equipment.

14 Claims, 1 Drawing Sheet

NON-METALLIC KNIFE

This application is a continuation of application Ser. No. 07/170,807 filed on Mar. 21, 1988, now abandoned.

FIELD OF THE INVENTION

The invention generally relates to knives. More specifically, it relates to knives for use in outdoor activities such as hunting, camping and particularly underwater activities such as scuba diving.

BACKGROUND OF THE INVENTION

A knife is a useful tool for scuba divers who often need to cut rope, fish lines, and other underwater objects made of a variety of materials such as plastic, steel, aluminum, wood, glass, and the like. However, no single knife blade can ordinarily cut all of these different types of materials with the same efficiency. For instance, some blades may be used to cut through 100 lb. test monofilament quickly and easily, but cannot be used to cut through glass or steel. Another blade which may be used to cut through glass, may also cut monofilament plastic, but not as quickly or efficiently as other blades.

There are other concerns which are particularly relevant to knives which are to be used in underwater environments, including salt water environments. First, normal steel blades corrode and rust after extended exposure to water, particularly salt water. Further, scuba equipment should be as light as possible since the diver must carry a substantial amount of heavy breathing equipment, tools and air tanks.

Conventional means of metal shaping and forming to produce knife blades leads to several additional drawbacks. For instance, specially shaped blades are frequently useful for underwater work. Such intricate blade shapes are extremely costly to manufacture through conventional metal shaping or forming. In addition, steel blades have a highly reflective silver face. This is often undesirable for scuba diving since highly reflective surfaces can attract undesireable sea creatures or, on the other hand, frighten away other sea creatures which the diver wishes to observe.

Therefore, it is an object of the present invention to provide a knife for scuba divers that is light in weight, provides a plurality of different cutting blades to increase the usefulness of the knife and is extremely durable.

It is a further object of the present invention to provide a knife which ca be easily and inexpensively manufactured with various and/or intricate blade shapes.

It is a further object of the present invention to provide a knife with interchangeable blades for replacement with a new blade when the old blade wears out or when a different blade shape or material is desired.

It is yet another object of the present invention to provide an attractive knife which can be manufactured in an unlimited variety of colors and surface textures, and which provides storage means for O-rings.

SUMMARY OF THE INVENTION

The knife of the present invention has a handle and blade support monolithically molded of a strong plastic that can have an unlimited number of colors and surface textures. The blade support has two cutout sections on opposing sides of its length for installation of cutting blades or tools. In a preferred embodiment, a stainless steel serrated cutting blade useful for cutting plastic rope such as mono or multifilament nylon and polypropylene is secured to the blade support. The other element comprises a round rod saw blade coated with carbide tungsten for cutting through steel, aluminum, glass and the like. One or both of the blades are removable and interchangeable.

A cylindrical metal butt cap with qrooves therein for storing spare 0 rings extends from the handle opposite the blade end. These rings are used in scuba diving equipment.

DETAILED DESCRIPTION OF THE PREFERRED EMBODIMENT

Figure 1:
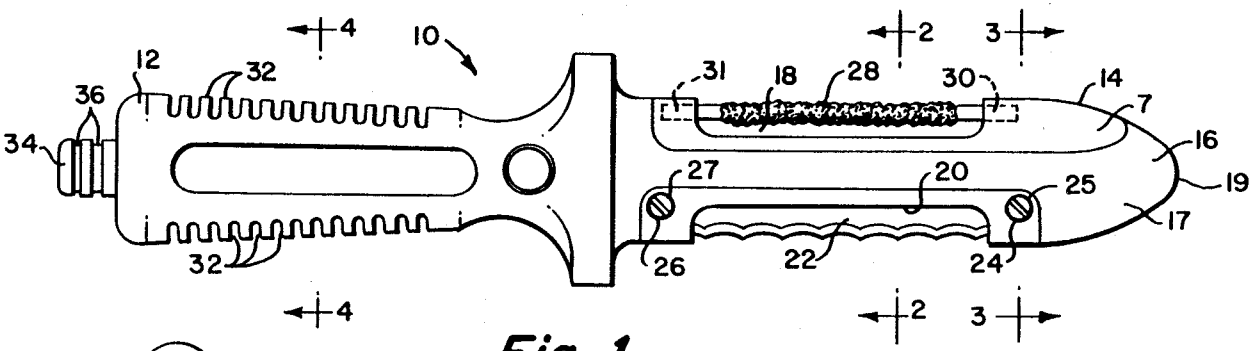
FIG. 1 shows a plan view of a preferred embodiment of a knife embodying the present invention.
Figure 4:
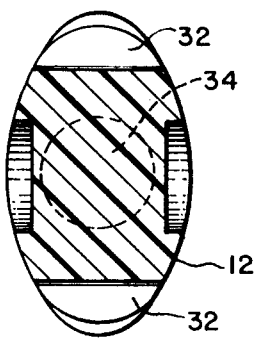
FIG. 4 is a cross section view taken along the line 4—4 of FIG. 1.
Figure 3:
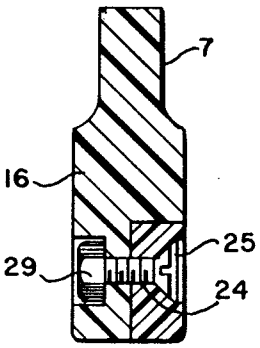
FIG. 3 is a cross section view taken along the line 3—3 or FIG. 1.

The knife 10 shown in FIG. 1 comprises a handle portion 12 and blade support 14. The blade support 14 has a base section 1 that is monolithically constructed with the handle 12. The handle 12 and blade base 16 are comprised of a plastic that is molded into the desired shape. Because the handle and blade support is constructed of a plastic, it can have any desired color and may be molded in a wide variety of shapes. For example, the blade base 16 can be molded with instructional or identifying words or pictures. Since plastic is used, the knife is substantially lighter in weight than a similar knife constructed of metal.

In the embodiment shown in FIG. 1, the blade base 16 is formed on one side with a longitudinal tapered section 7 and with two recesses or cutout sections 18 and 20 on opposite sides of the blade base 16. A removable stainless steel serrated blade 22 is secured in the recess or cutout 20 by two screws 25 and 27 which are secured in threaded holes 24 and 26 in the base 16 by nuts 29 in rectangular recesses on the side of the blade 22 opposite the heads of screws 25 and 27.

Figure 2:
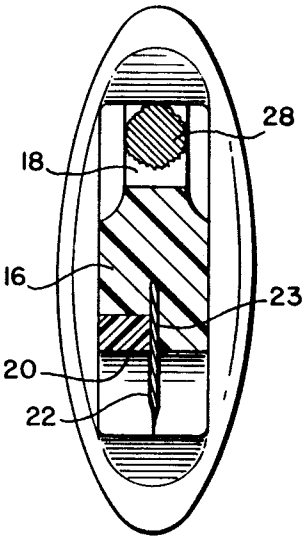
FIG. 2 is a cross section taken along the line 2—2 of FIG. 1.

As shown in FIG. 2, the stainless steel blade 22 is secured to the blade base 16 with the longitudinal edge opposite the cutting edge positioned in a groove 23 in the blade base 16, thereby providing extra rigidity to the blade.

A second blade 28 which, in this embodiment, is a round rod saw blade is secured on the opposite side of the base 16. This rod saw blade 28 is preferrably constructed of an extremely hard material. In the preferred embodiment, the blade 28 is coated with tungsten carbide which is capable of sawing through glass and steel. The ends of rod saw blade 28 are molded into the recess or cutout 20 at points 30 and 31. Alternately, the blade 28 may be removably attached in the same manner as blade 22, i.e. by screws and nuts. As shown in FIGS. 1 and 2, the blade 28 is spaced from the base 16, thus permitting free movement of water about the blade 28.

The stainless steel blade 22 is particularly adapted for very quick cutting of such items as heavy nylon and polypropylene monofilament ropes and lines, as well as underwater vegetation and the like. The rod saw blade 28, on the other hand, is particularly adapted for cutting through hard substances such as glass, steel, aluminum, and the like.

Since the handle 12 and blade base 16 are constructed of a plastic, it will be extremely durable as well as rust and corrosion free. In addition, it can be monochromatic in any desired color. Further, the handle and blade base may be given any desired surface texture. For instance a dark textured surface with very low reflectivity may be desirable in order to avoid attracting certain sea creatures that are attracted to light.

The tip 17 of the blade base 16 remote from the handle 12 is tapered to an edge at 19 in order to form a wedge shape so that the knife tip can be used for prying and poking. If the blade base 16 is made of a suitable plastic such as Zytel plastic, it should be sufficiently strong and durable for such uses.

Since blade 22 and, if desired, blade 28 are removably attached to the blade base 16 by screws, worn or broken blades may be replaced without having to replace the entire knife. In addition, if one end of a blade becomes worn while the other end remains sharp, the blade can be removed and replaced in the opposite orientation, so that the sharp end is in a more advantageous position. Various types of blades may be provided for securing in cutouts 18 and 20 without the need for a second knife.

A plurality of grooves 32 are formed on opposite sides of the handle 12 along its length for better gripping. A stainless steel butt cap 34 is secured in the end of the handle 12 opposite the blade. The butt cap 34 is preferably cylindrical in shape with a plurality of annular qrooves 36 formed therein. The butt cap 34 and grooves 36 are of such a size that standard size O-rings for scuba equipment can be interlockingly engaged on the grooves thereby providing a place to store spare O-rings.

It should be understood that the preceeding is merely a detailed description of a preferred embodiment. It will be obvious to those skilled in the art that various modifications can be made without departing from the spirit or scope of the invention. The preceeding description is meant to describe only a preferred embodiment and not to limit the scope of the invention. The invention is limited only by the following claims.

We claim:

1. A knife comprising an integrally formed plastic handle and an elongated blade support;

said blade support having integrally formed therein a plurality of recesses extending longitudinally of the blade support, and a plurality of cutting tools positioned one each in said recesses, wherein at lest one of said cutting tools is formed with holes at its ends, and means extending through said holes to moveably secure said at least one of said cutting tools to said base.

2. A knife as set forth in claim 3 wherein said cutting tools include a blade, and said means for securing said tools includes means for removably securing at least one of said tools for selective replacement.

3. A knife as set forth in claim 2 wherein at least one of said blades comprises a cylindrical element having an abrasive cutting surface.

4. A knife as set forth in claim 3 wherein said cylindrical element is coated with tungsten carbide.

5. A knife as set forth in claim 1 having a metal butt cap secured to said handle opposite said blade support, said butt cap being substantially cylindrical in shape and having a plurality of parallel circular grooves about the circumference of the butt cap, sized to receive standard rubber O-rings in an interlocking fit.

6. A knife as set forth in claim 1 wherein the cutting tools comprise exposed longitudinal cutting surfaces and wherein said exposed longitudinal cutting surfaces are positioned within said recesses.

7. A knife as set forth in claim 6 wherein one of said blade removably secured to said base has a serrated edge and another of said blades comprising a cylindrical element is permanently secured in said base.

8. A knife comprising an integrally formed plastic handle and an elongated blade support extending longitudinally outwardly from said plastic handle;

said blade support having integrally formed therein a plurality of recesses extending longitudinally of the blade support, and a plurality of cutting tools having cutting surfaces positioned in said recesses such that the cutting surfaces are disposed entirely within the recesses.

9. A knife as set forth in claim 8 further comprising a means for removably securing said cutting tools to said blade support.

10. A knife as set forth in claim 9 wherein said cutting tools include at least one blade with holes formed at opposite ends, and means extending through said holes to removably secure said blade to said blade support.

11. A knife as set forth in claim 10 wherein at least one of said cutting tools comprises a tungsten carbide rod.

12. A knife for underwater use comprising an integrally formed plastic handle and an elongated blade support extending longitudinally outwardly from said handle, a plurality of cutting tools on said blade support between the handle and a position short of the end of the blade support remote from said handle, and means for securing said cutting tools to said blade support.

13. A knife as set forth in claim 12 wherein said remote end of said blade support forms a wedge.

14. A knife as set forth in claim 12 wherein said means securing said tools comprises elongated recesses in said blade support with said cutting tools in said recesses and means locking said cutting tools in said elongated recess.

* * * * *